US007726766B2

(12) United States Patent
Ishikawa

(10) Patent No.: US 7,726,766 B2
(45) **Date of Patent: *Jun. 1, 2010**

(54) IMAGE FORMING APPARATUS

(75) Inventor: Kan Ishikawa, Toyoake (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 465 days.

This patent is subject to a terminal disclaimer.

(21) Appl. No.: 11/589,488

(22) Filed: Oct. 30, 2006

(65) Prior Publication Data

US 2007/0097167 A1 May 3, 2007

(30) Foreign Application Priority Data

Oct. 31, 2005 (JP) ..... 2005-317047

(51) Int. Cl.
*B41J 29/393* (2006.01)

(52) U.S. Cl. ..... 347/19; 347/5; 347/13

(58) Field of Classification Search ..... 347/14, 347/16, 19, 5, 9, 12, 13, 15; 346/139 R
See application file for complete search history.

(56) References Cited

U.S. PATENT DOCUMENTS 5,245,359 A * 9/1993 Ito et al. ..... 346/139 R
6,827,421 B2 * 12/2004 Nunokawa et al. ..... 347/19
6,940,150 B2 9/2005 Watanabe
7,438,380 B2 * 10/2008 Ishikawa ..... 347/19
2005/0285271 A1 12/2005 Watanabe

FOREIGN PATENT DOCUMENTS

| | | |
|---|---|---|
| JP | 5162420 | 6/1993 |
| JP | 6286255 | 10/1994 |
| JP | 8258360 | 10/1996 |
| JP | 2002127569 | 5/2002 |
| JP | 2003-17559 | 1/2003 |

* cited by examiner

*Primary Examiner*—Lam S Nguyen
(74) *Attorney, Agent, or Firm*—Eugene LeDonne; Joseph W. Treloar; Frommer Lawrence & Haug LLP

(57) ABSTRACT

An image forming apparatus is provided which can detect abnormality in a conveyance system of a carriage by a change in posture of the carriage. The image forming apparatus includes an image forming device that forms an image onto a recording medium by moving a carriage which mounts a recording head thereon, an angular speed detection device that detects an angular speed around a predetermined axis of the carriage, and a abnormality determination device that determines abnormality in a conveyance system that moves the carriage based on whether the angular speed detected by the angular detection device when the carriage is moved exceeds a predetermined abnormality determination value.

6 Claims, 9 Drawing Sheets

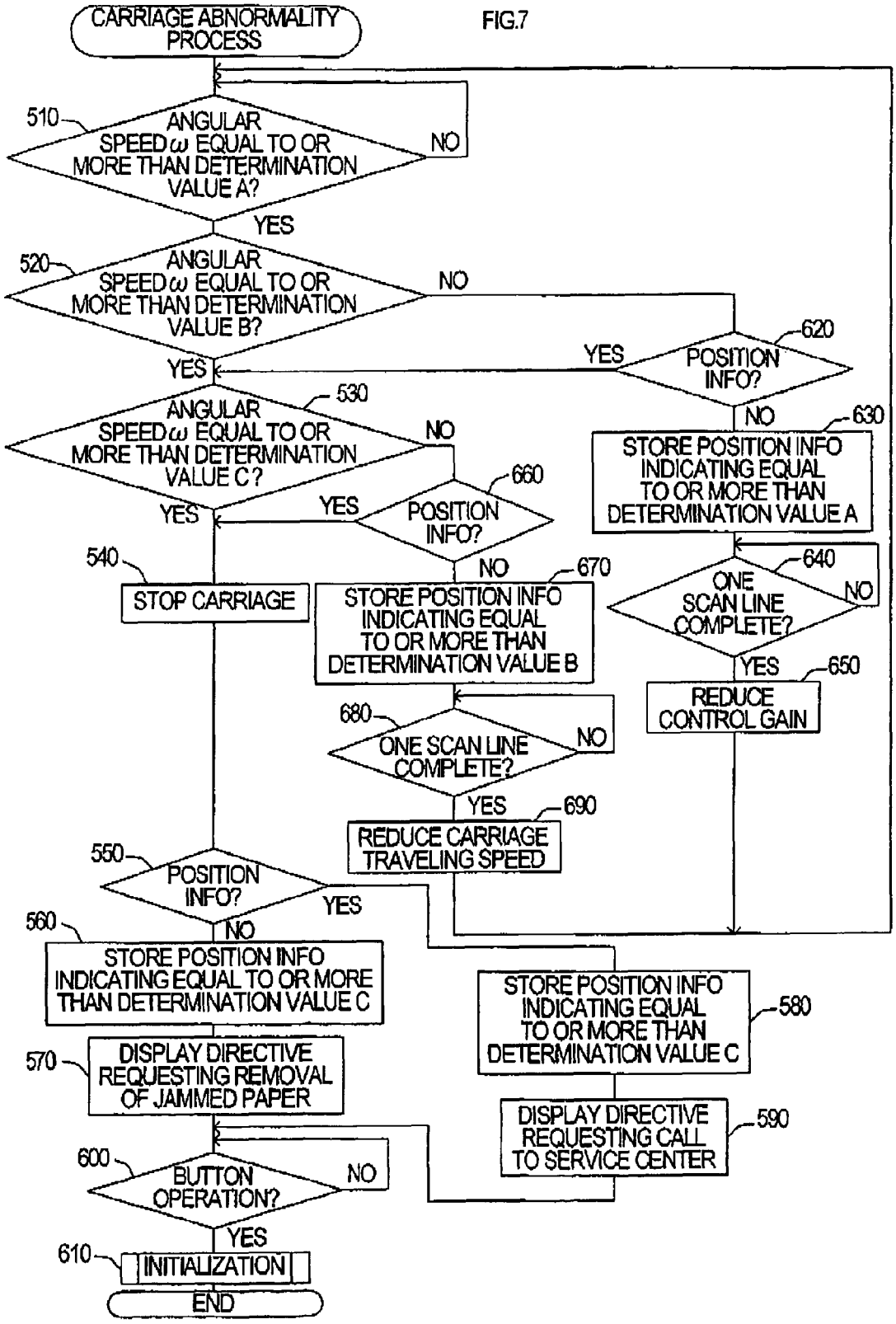
CARRIAGE ABNORMALITY PROCESS
FIG.7
510
ANGULAR SPEED ω EQUAL TO OR MORE THAN DETERMINATION VALUE A?
NO
YES
520
ANGULAR SPEED ω EQUAL TO OR MORE THAN DETERMINATION VALUE B?
NO
YES
620
POSITION INFO?
YES
NO
630
STORE POSITION INFO INDICATING EQUAL TO OR MORE THAN DETERMINATION VALUE A
530
ANGULAR SPEED ω EQUAL TO OR MORE THAN DETERMINATION VALUE C?
NO
YES
660
POSITION INFO?
YES
NO
640
ONE SCAN LINE COMPLETE?
NO
YES
650
REDUCE CONTROL GAIN
540
STOP CARRIAGE
670
STORE POSITION INFO INDICATING EQUAL TO OR MORE THAN DETERMINATION VALUE B
680
ONE SCAN LINE COMPLETE?
NO
YES
690
REDUCE CARRIAGE TRAVELING SPEED
550
POSITION INFO?
YES
NO
560
STORE POSITION INFO INDICATING EQUAL TO OR MORE THAN DETERMINATION VALUE C
570
DISPLAY DIRECTIVE REQUESTING REMOVAL OF JAMMED PAPER
580
STORE POSITION INFO INDICATING EQUAL TO OR MORE THAN DETERMINATION VALUE C
590
DISPLAY DIRECTIVE REQUESTING CALL TO SERVICE CENTER
600
BUTTON OPERATION?
NO
YES
610
INITIALIZATION
END

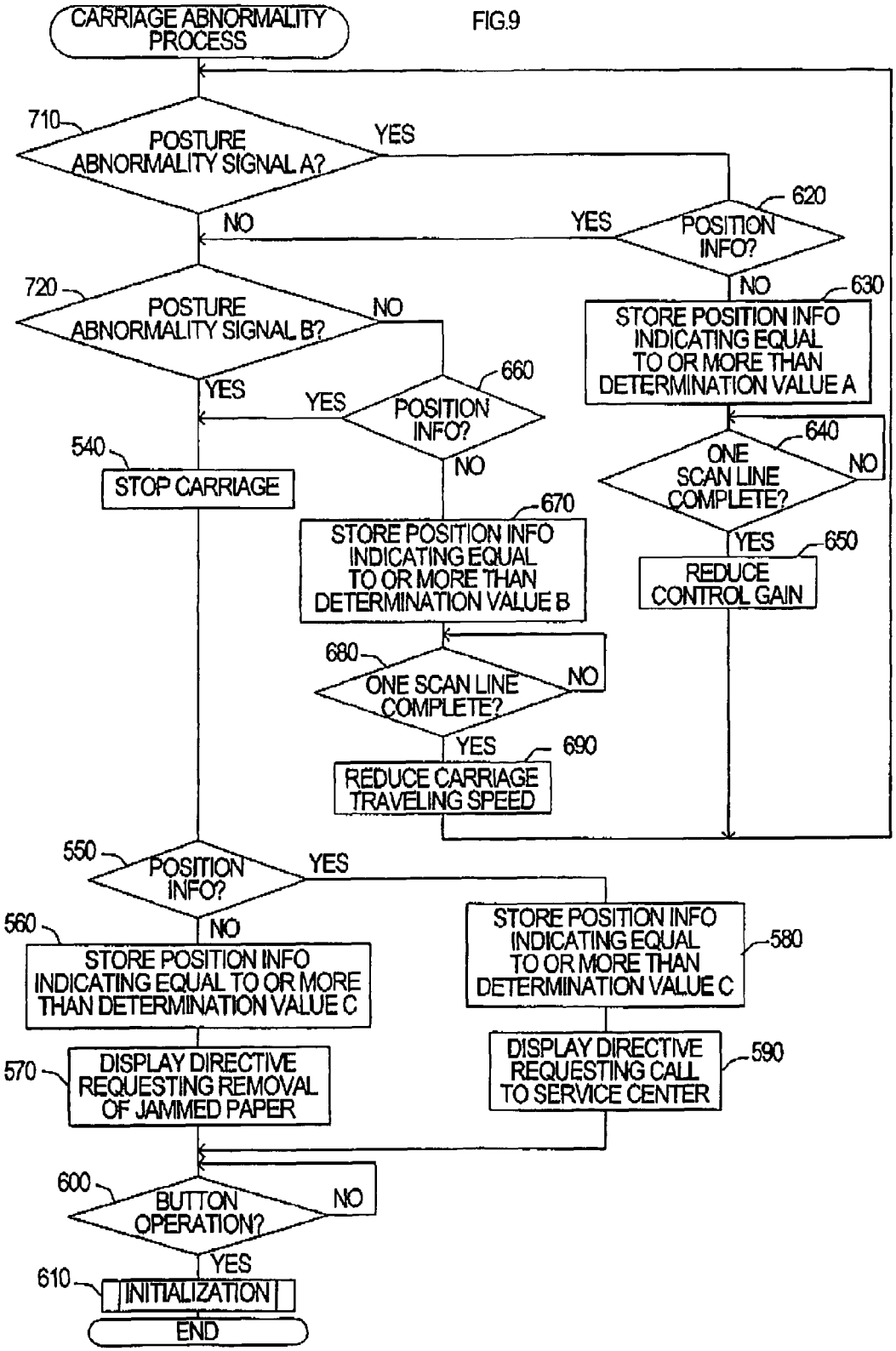
CARRIAGE ABNORMALITY PROCESS
FIG.9
710
POSTURE ABNORMALITY SIGNAL A?
YES
NO
620
POSITION INFO?
YES
NO
630
STORE POSITION INFO INDICATING EQUAL TO OR MORE THAN DETERMINATION VALUE A
720
POSTURE ABNORMALITY SIGNAL B?
NO
YES
660
POSITION INFO?
YES
NO
640
ONE SCAN LINE COMPLETE?
NO
YES
650
REDUCE CONTROL GAIN
540
STOP CARRIAGE
670
STORE POSITION INFO INDICATING EQUAL TO OR MORE THAN DETERMINATION VALUE B
680
ONE SCAN LINE COMPLETE?
NO
YES
690
REDUCE CARRIAGE TRAVELING SPEED
550
POSITION INFO?
YES
NO
560
STORE POSITION INFO INDICATING EQUAL TO OR MORE THAN DETERMINATION VALUE C
580
STORE POSITION INFO INDICATING EQUAL TO OR MORE THAN DETERMINATION VALUE C
570
DISPLAY DIRECTIVE REQUESTING REMOVAL OF JAMMED PAPER
590
DISPLAY DIRECTIVE REQUESTING CALL TO SERVICE CENTER
600
BUTTON OPERATION?
NO
YES
610
INITIALIZATION
END

IMAGE FORMING APPARATUS

CROSS-REFERENCE TO RELATED APPLICATIONS

This application claims the benefit of Japanese Patent Application No. 2005-317047 filed Oct. 31, 2005 in the Japan Patent Office, the disclosure of which is incorporated herein by reference.

BACKGROUND

This invention relates to an image forming apparatus that forms an image onto a recording medium by moving a carriage with a recording head mounted thereon.

Conventional image forming apparatus are known to form an image onto a recording medium by moving a recording medium in a sub-scanning direction and moving a carriage mounting a recording head thereon along a guide portion in a main scanning direction.

In this type of image forming apparatus, abnormality sometimes occurs in a conveyance system of the carriage owing to various causes like foreign bodies caught in the guide portion or a failure of a driving motor of the carriage during image forming. As a result, the apparatus may not be able to operate normally. For example, a distorted image may be formed or the recording medium may no longer be conveyed. If the apparatus is in a state of abnormality, the operation of the apparatus must be stopped and the abnormality in the operation of the apparatus must be notified to the user. Thus, prompt detection of abnormality is essential.

Therefore, for example, an image forming apparatus has been proposed which detects the position of a carriage on a guide portion and determines whether a conveyance system of the carriage is normal based on information on the detected position so as to detect abnormality of the apparatus.

SUMMARY

The proposed image forming apparatus, however, determines whether the conveyance system of the carriage is normal based on the position information of the carriage in a main scanning direction. Therefore, while it is possible to detect a stop of the carriage or a decrease in traveling speed of the carriage, it is not possible to detect, for example, local deformation of the guide portion or a change in posture of the carriage due to a hindrance on the guide portion. Accordingly, it is not possible to detect abnormality of the apparatus such as image distortion and application of a load to the guide portion which result from the change in posture of the carriage.

The present invention is made to solve the above problems. It would be desirable to be able to determine abnormality in a conveyance system of a carriage mounting a recording head thereon.

It is desirable that an image forming apparatus of the present invention includes an image forming device that forms an image onto a recording medium by moving a carriage mounting a recording head thereon; an angular speed detection device that detects an angular speed around a predetermined axis of the carriage; and an abnormality determination device that determines abnormality in a conveyance system that moves the carriage based on whether the angular speed detected by the angular detection device when the carriage is moved exceeds a predetermined abnormality determination value.

According to the image forming apparatus of the present invention, abnormality in the conveyance system of the carriage, while the carriage is moved on a guide portion, caused by a hindrance present in a moving path of the carriage or deformation of a guide member of the carriage, for example, can be determined from a change in angular speed around the predetermined axis of the carriage, that is, a change in posture of the carriage.

BRIEF DESCRIPTION OF THE DRAWINGS

The invention will now be described below, by way of example, with reference to the accompanying drawings, in which:

FIG. 7 is a flowchart illustrating a carriage abnormal process according to the embodiment;

FIG. 9 is a flowchart illustrating a carriage abnormal process according to the variation.

DETAILED DESCRIPTION OF THE PREFERRED EMBODIMENT

Figure 1:
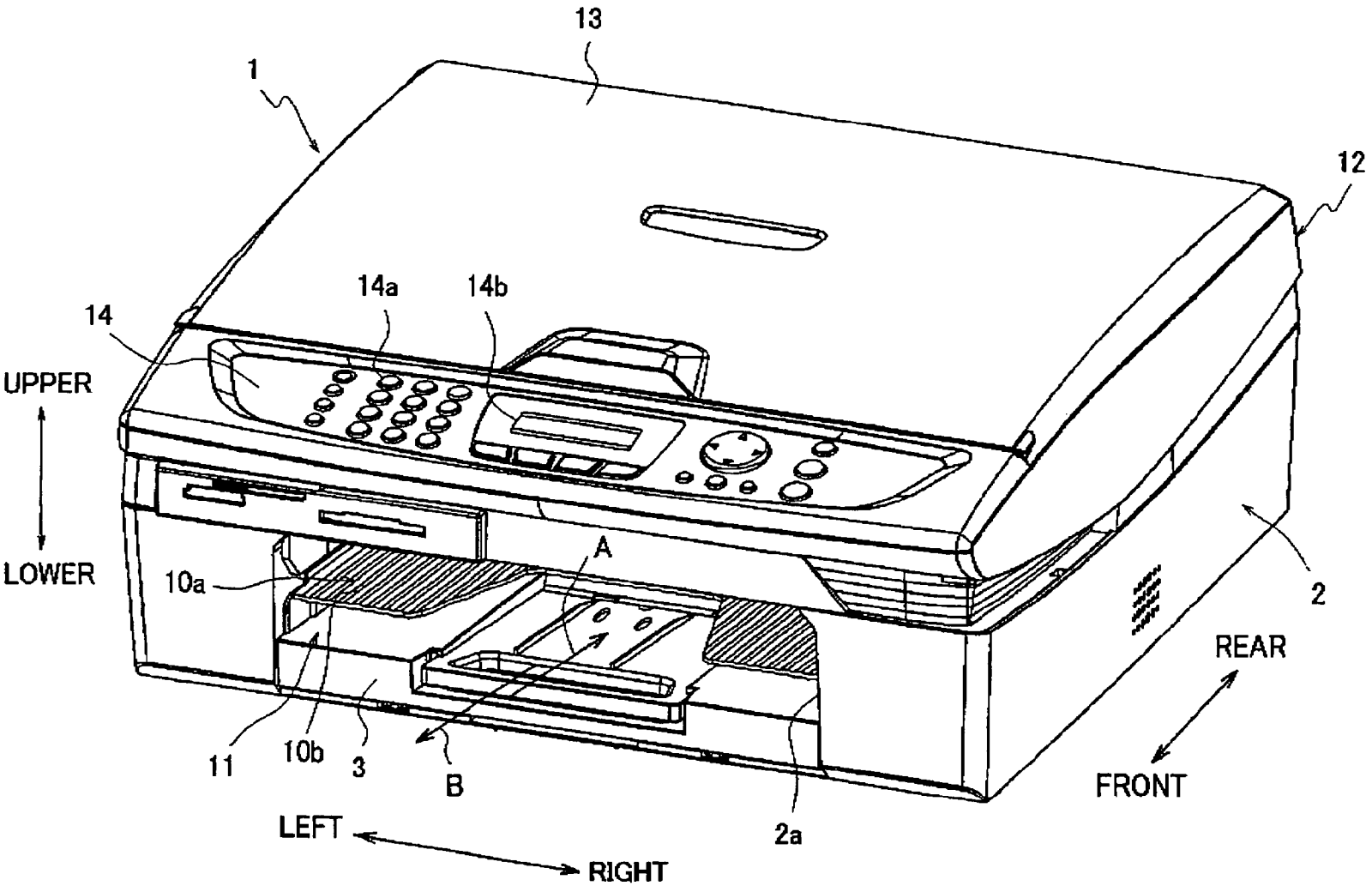
FIG. 1 is a perspective view of a multi function apparatus according to an embodiment.
Figure 2:
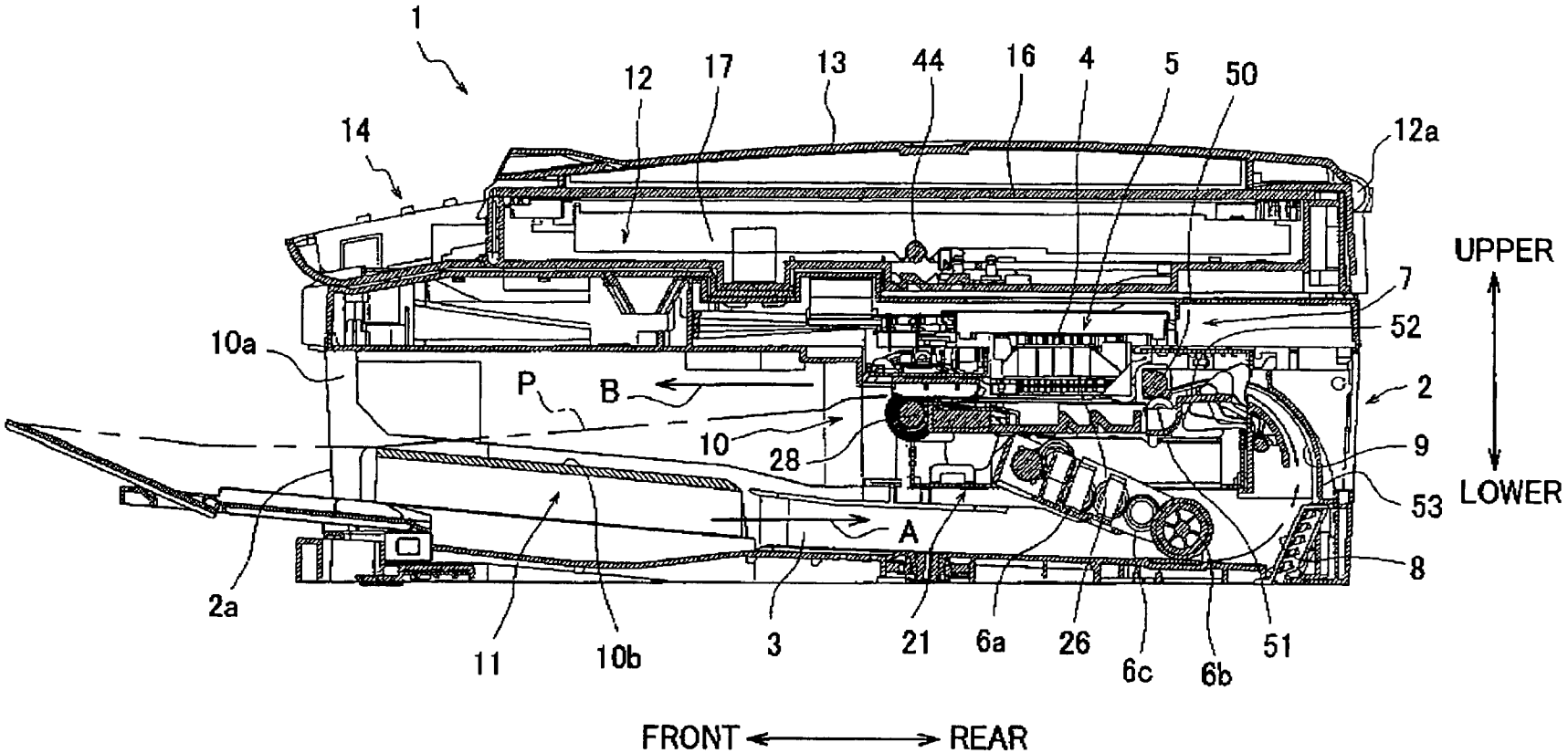
FIG. 2 is a cross sectional side view of the multi function apparatus according to the embodiment.

A multi function apparatus 1 (MFD) of the present embodiment is provided with a printer function, a copying function, a scanner function and a facsimile function. As shown in FIGS. 1 and 2, an image reader 12 used for reading a document is provided above a housing 2.

The image reader 12 is designed to be opened and closed with respect to the housing 2 about a not shown pivot shank provided at a left end of the image reader 12.

A cover 13 which covers the upper surface of the image reader 12 is turnably attached to the image reader 12 so as to be opened and closed with respect to the image reader 12 about a pivot shaft 12*a* (see FIG. 2) provided at a rear end of the cover 13.

A glass plate 16 is provided on the upper surface of the image reader 12. When the cover 13 is opened up, a document can be set on the glass plate 16 to be read. A contact image scanner (CIS) 17 for reading a document is provided below the glass plate 16. The contact image scanner can reciprocate along a guide shaft 44 which extends in a direction orthogonal to the sheet surface of FIG. 2 drawing (main scanning direction or right and left direction).

An operation panel 14 including operation buttons 14*a* for input operation and a liquid crystal display (LCD) 14*b* for displaying various information is provided at the front of the image reader 12.

A feeding unit 11 for feeding recording paper P is provided at the bottom of the housing 2. The feeding unit 11 includes a paper cassette 3 which can be attached to or detached from the housing 2 in a cross direction via an opening 2*a* which is formed at the front side of the housing 2. In the present embodiment, the paper cassette 3 is designed to store a plurality of recording paper P in A4, letter, legal, and postcard sizes in a stack (accumulated manner). The recording paper P is arranged such that its narrow sides (width) extend in a direction (main scanning direction or right and left direction) orthogonal to a paper feeding direction (sub-scanning direction, cross direction, or direction of an arrow A).

A tilted separator 8 for recording paper separation is disposed at the back (rear end) side of the paper cassette 3. The tilted separator 8 is formed into a convex curvature in a plan view so as to protrude at the middle and to be dented toward the right and left ends in a width direction (right and left direction) of the recording paper P. A saw-edged elastic separation pad is provided at the middle in the width direction of the recording paper P. The separation pad abuts the front edge of the recording paper P to expedite separation.

Behind the feeding unit 11, a feed arm 6*a* for feeding the recording paper P from the paper cassette 3 is turnably attached so as to swing up and down on its anchor end. A rotational driving force from an LF (conveying) motor 54 (see FIG. 4) is transmitted to a feed roller 6*b* provided at a tip end of the arm 6*a* via a gear transmission mechanism 6*c* provided inside the feed arm 6*a*. The recording paper P stacked in the paper cassette 3 is separately conveyed sheet by sheet by the feed roller 6*b* and the aforementioned elastic separation pad of the tilted separator 8.

The recording paper P which is separated to advance along the paper feeding direction (direction of the arrow A) is fed to a recording unit 7 via a paper feeding path 9 which includes a U-turn path formed in a space between a first feeding guide 52 and a second feeding guide 53. The recording unit 7 is provided above the paper cassette 3.

Figure 3:
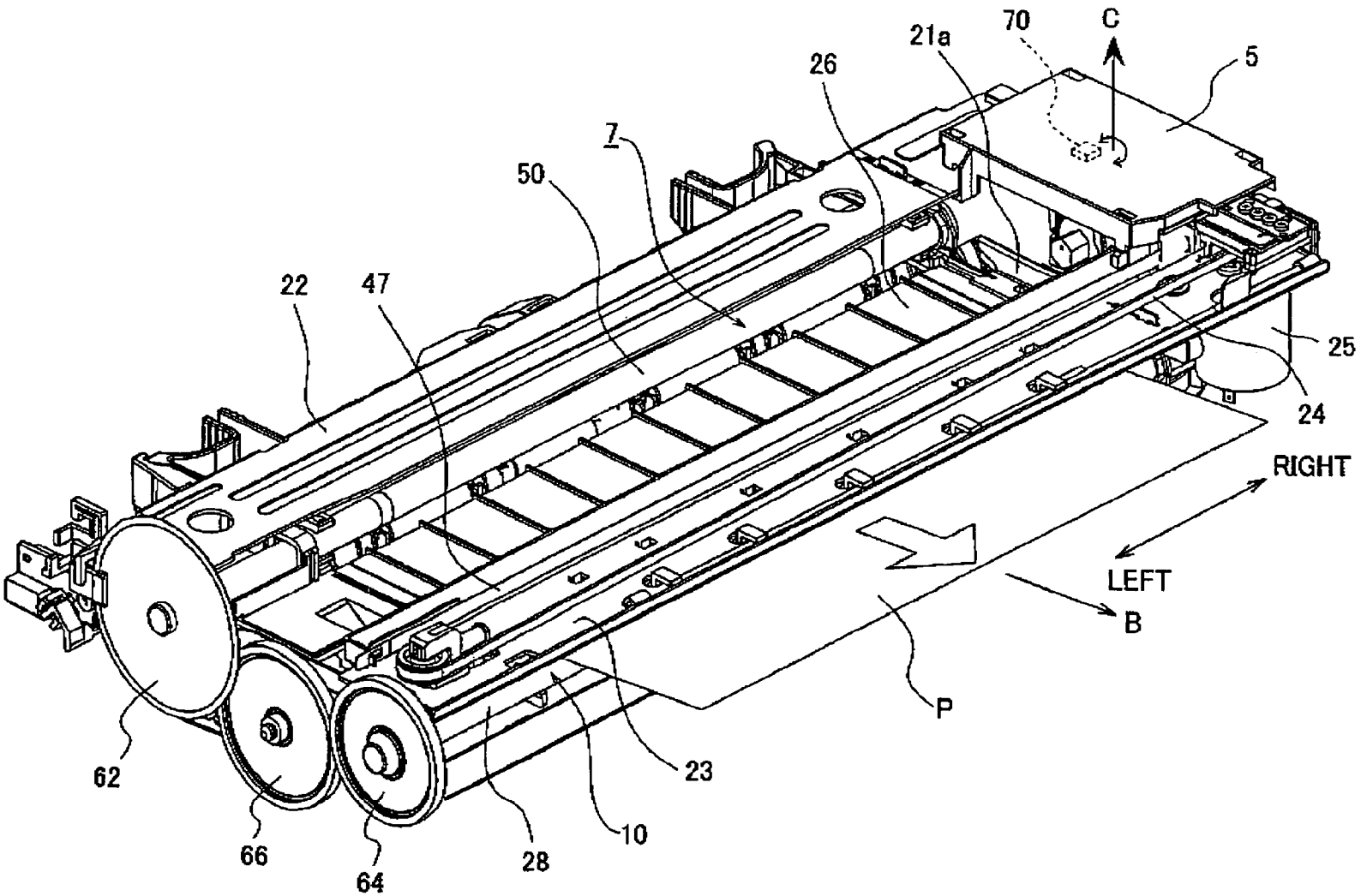
FIG. 3 is an explanatory view showing a structure of a recording portion of the multi function apparatus according to the embodiment.

As seen from FIG. 3, the recording unit 7 is provided between a main frame 21 formed into a box opened upward and first and second plate-like guide members 22 and 23 which are supported by a pair of right and left side boards 21*a* of the main frame 21 and extend in right and left direction (main scanning direction). The recording unit 7 includes an ink-jet recording head 4 (see FIG. 2) which ejects ink from the bottom side to record an image onto the recording paper P, and a carriage 5 which mounts the recording head 4 thereon.

The carriage 5 is slidably supported between the first guide member 22 located upstream and the second guide member 23 located downstream in a discharge direction (direction of an arrow B) so as to reciprocate in right and left direction. In order to reciprocate the carriage 5, a timing belt 24 makes a loop on the upper side of the second guide member 23 in a manner to extend in the main scanning direction (right and left direction). A CR (carriage) motor 25 which drives the timing belt 24 is fixed to the down side of the second guide member 23.

A timing slit 78*a* is provided on the second guide member 23. Slits having a constant width and a certain interval therebetween (e.g., 1/150 inches=approximately 0.17 mm) along the main scanning direction are formed on the timing slit 78*a*. A guide groove which opens downward is formed on the bottom surface of the carriage 5 on the side of the second guide member 23. The timing slit 78*a* passes through the guide groove in the main scanning direction (right and left direction). A detection unit which includes a photo interrupter (not shown) is provided adjacent to the guide groove. The photo interrupter includes one light emitting element and two light receiving elements arranged on the opposite sides of the timing slit 78*a*. Thus, the detection unit outputs a pulse signal having two phases (A phase and B phase), every time the carriage 5 is moved in the main scanning direction and the slits on the timing slit 78*a* pass between the one light emitting element and the two light receiving elements. The detection unit including the photo interrupter constitutes a linear encoder 78 together with the timing slit 78*a*.

The carriage 5 includes a gyro sensor 70 (see FIGS. 3 and 4) which is formed through the same semiconductor manufacturing process with the recording head 4 at the time of manufacturing the recording head 4. The gyro sensor 70 detects an angular speed around an axis perpendicular to a surface on which a moving path of the carriage 5 exists, that is, an axis perpendicular to the recording paper P (see FIG. 3: hereinafter, also referred to as a C axis) on which an image is to be formed.

A flat platen 26 is provided below the recording head 4 of the carriage 5 in the recording unit 7. The flat platen 26 faces the recording head 4 and extends in right and left direction. The platen 26 is fixed to the main frame 21 between the guide members 22 and 23.

A conveying roller 50 and a nip roller 61 (see FIG. 2) are provided on the upstream side in the discharge direction (direction of the arrow B) of the platen 26. The conveying roller 50 conveys the recording paper P to the under side of the recording head 4. The nip roller 51 is biased to the conveying roller 50 side to face the conveying roller 50. A discharge roller 28 and a spur roller (not shown) are provided on the downstream side of the discharge direction (direction of the arrow B) of the platen 26. The discharge roller 28 is driven to convey the recording paper P which has passed the recording unit 7 to the discharge unit 10 along the discharge direction (direction of the arrow B). The spur roller is biased to the discharge roller 28 side to face the discharge roller 28.

An LF motor 54 (see FIG. 4) is fixed inside the main frame 21. A rotation shaft of the LF motor 54 protrudes to the outside of the left side board 21*a* toward the discharge direction (direction of the arrow B). A driving gear (not shown) is secured to the rotation shaft of the LF motor 54. The driving gear transmits power from the LF motor 54 to the conveying roller 50, the discharge roller 28 and the feed roller 6*b* (particularly the gear transmission mechanism 6*c* provided inside the feeding arm 6*a*).

Respective rotation shafts of the conveying roller 50, the discharge roller 28 and the gear transmission mechanism 6*c* also protrude to the outside of the side board 21*a* provided with the driving gear. Driven gears 62, 64 and 66, which are directly or indirectly via another gear connected to the driving gear and receive power from the LF motor 54, are fixed to the respective rotation shafts.

A disk-shaped slit board 56*a* is attached to the conveying roller 50. The slit board 56*a* has a plurality of slits formed around its external periphery with even intervals. Thus, the slit board 56*a* rotates in conjunction with the conveying roller 50. A photo interrupter 56*b* is disposed on the side boards 21*a*. The photo interrupter 56*b* includes one light emitting element and two light receiving elements arranged on the opposite sides of the slit board 56*a*. Thus, the photo interrupter 56*b* outputs a pulse signal having two phases (A phase and B phase), every time the slits on the slit board 56*a* pass between the one light emitting element and the two light receiving elements. The one light emitting element and two light receiving elements are arranged such that the A phase signal and the B phase signal are different in phase by $\pi/2$. The slit board 56*a* constitutes a rotary encoder 56 together with the photo interrupter 56*b*.

As can be seen in FIG. 2, the discharge unit 10 is disposed above the feeding unit 11. The recording paper P after recorded in the recording unit 7 is discharged to the discharge unit 10 with its recording surface upward. A discharge hole 10*a* opens toward the front of the housing 2 together with the opening 2*a*. The recording paper P discharged along the discharge direction (direction of the arrow B) from the discharge unit 10 is accumulated and stored on the discharge tray 10*b* located inside the opening 2*a*.

A not shown ink storage is provided on the right end at the front of the housing 2 below the image reader 12. Four ink cartridges are provided in the ink storage, which respectively store black (Bk) ink, cyan (C) ink, magenta (M) ink, and yellow (Y) ink for full color recording. The respective ink cartridges can be attached to and detached from the ink storage when the image reader 12 is opened upward.

The respective ink cartridges are connected to the recording head 4 via four flexible ink supply tubes. Ink stored in the respective ink cartridges is supplied to the recording head 4 via the ink supply tubes.

Figure 4:
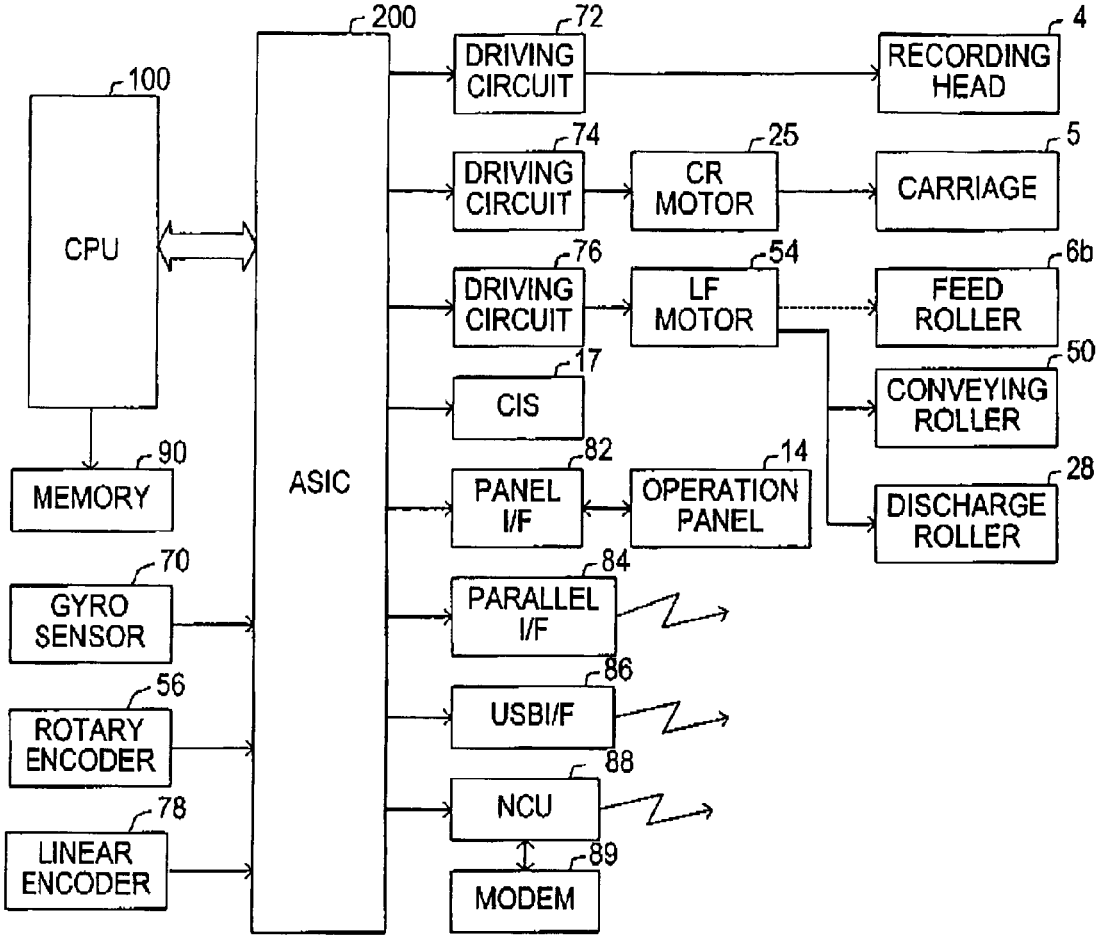
FIG. 4 is a block diagram showing a structure of a whole control system of the multi function apparatus according to the embodiment.

FIG. 4 is a block diagram showing a structure of a whole control system of the multi function apparatus 1.

As shown in FIG. 4, the control system of the multi function apparatus 1 mainly includes a microcomputer (hereinafter, simply referred to as CPU) 100 constituted of a CPU, a ROM and a RAM, and an ASIC (Application Specific Integrated Circuit) 200. The CPU 100 controls the whole apparatus 1 in a comprehensive manner. The ASIC 200 drives and controls the aforementioned parts (the LF motor 54, the CR motor 25, the recording head 4, the CIS 17, etc.) according to directives from the CPU 100.

The CIS 17, and respective driving circuits 72, 74 and 76 for the recording head 4, the CR motor 25 and the LF motor 54, are connected to the ASIC 200. The rotary encoder 56 that detects a rotation angle and a rotation speed of the conveying roller 50, the linear encoder 78 that detects a traveling speed and a position of the carriage 5 which is moved in a main scanning direction by rotation of the CR motor 25, and the gyro sensor 70 that detects an angular speed ω of the carriage 5 around the C axis are also connected to the ASIC 200.

Also connected to the ASIC 200 are a panel interface (panel I/F) 82 that is used to receive and input to the CPU 100 information entered by a user via operation buttons 14*a* of the operation panel 14 as well as to display various message on a liquid crystal display 14*b* of the operation panel 14 according to display directives from the CPU 100, a parallel interface (parallel I/F) 84 and a USB interface (USB I/F) 86 that are used to communicate with external apparatus such as a personal computer via a parallel cable or a USB cable, and a NCU (Network Control Unit) 88 that is used to communicate via PSTN (Public Switched Telephone Network). Connected to the NCU 88 is a modem 89 which demodulates a communication signal inputted to the NCU 88 from the PSTN and modulates, to a communication signal, data to be transmitted to the outside by facsimile transmission.

The rewritable memory 90 like an EEPROM is connected to the CPU 100. Data stored in the memory 90 is rewritten by the CPU 100.

That is, in the multi function apparatus 1 according to the present embodiment, the printer function, the copying function, the scanner function and the facsimile function are implemented by the operation of the CPU 100 and the ASIC 200.

When recording an image onto the recording paper P, the CPU 100 firstly rotates and drives the LF motor 54 toward a predetermined direction via the ASIC 200 so as to rotate the feed roller 6*b* toward the paper feeding direction. The recording paper P is fed from the paper cassette 3 toward the conveying roller 50.

Then, the CPU 100 rotates and drives the LF motor 54 toward the opposite direction by a predetermined amount at a time so as to rotate the conveying roller 50 and the discharge roller 28 toward a feeding direction of the recording paper P by the predetermined amount at a time. The recording paper P is moved on the platen 26 in a stepwise fashion.

When the recording paper P temporarily stops on the platen 26 as a result of the stepwise move of the recording paper P, the CPU 100 drives the CR motor 25 via the ASIC 200. The carriage 5 is moved in the main scanning direction while ink is ejected from the recording head 4 based on recorded data.

As a result, an image for one scan line is formed onto the recording paper P. The CPU 100 repeats a series of controls, that is, driving of the LF motor 54 (conveying of the recording paper P), driving of the CR motor 25 (moving of the carriage 5) and the driving of the recording head 4, via the ASIC 200 so as to form an image onto the entire recording paper P.

The LF motor 54 is driven and controlled by the ASIC 200 based on the rotation angle and the rotation speed of the conveying roller 50 which are calculated using the signal detected by the rotary encoder 56. The CR motor 25 is driven and controlled by the ASIC 200 based on the moving speed and the position of the carriage 5 which are calculated using the signal detected by the linear encoder 78.

The CPU 100 performs appropriate processes based on information inputted by a user via the operation buttons 14*a* of the operation panel 14. For example, when various setting values and setting directives are inputted from the operation panel 14, the CPU 100 stores the inputted values on a memory 90.

In the above multi function apparatus 1, abnormality may possibly occur in the conveyance system that moves the carriage 5 due to foreign bodies caught in the guide members 22 and 23 which support the carriage 5 or possible deformation of the guide members 22 and 23 which results from an external force applied to the multi function apparatus 1. If the carriage 5 moves on the guide members 22 and 23 and continues image forming in the presence of abnormality in the conveyance system of the carriage 5, the formed image may be distorted or the apparatus itself may fail due to a load applied to the carriage 5 and the guide members 22 and 23.

Accordingly, the multi function apparatus 1 of the present embodiment determines abnormality in the conveyance system of the carriage 5 based on whether the detection signal (i.e., angular speed ω of the carriage 5 around the C axis) outputted from the gyro sensor 70 inside the carriage 5 when the carriage 5 is moved (i.e., while the CR motor 25 is driven) exceeds a predetermined abnormality determination value. When the multi function apparatus 1 determines abnormality, the multi function apparatus 1 performs a predetermined process.

From now on, the determination of abnormality in the conveyance system of the carriage 5 and the process performed when abnormality is determined (referred to as a carriage abnormality process, hereinafter) are explained.

Figure 5:
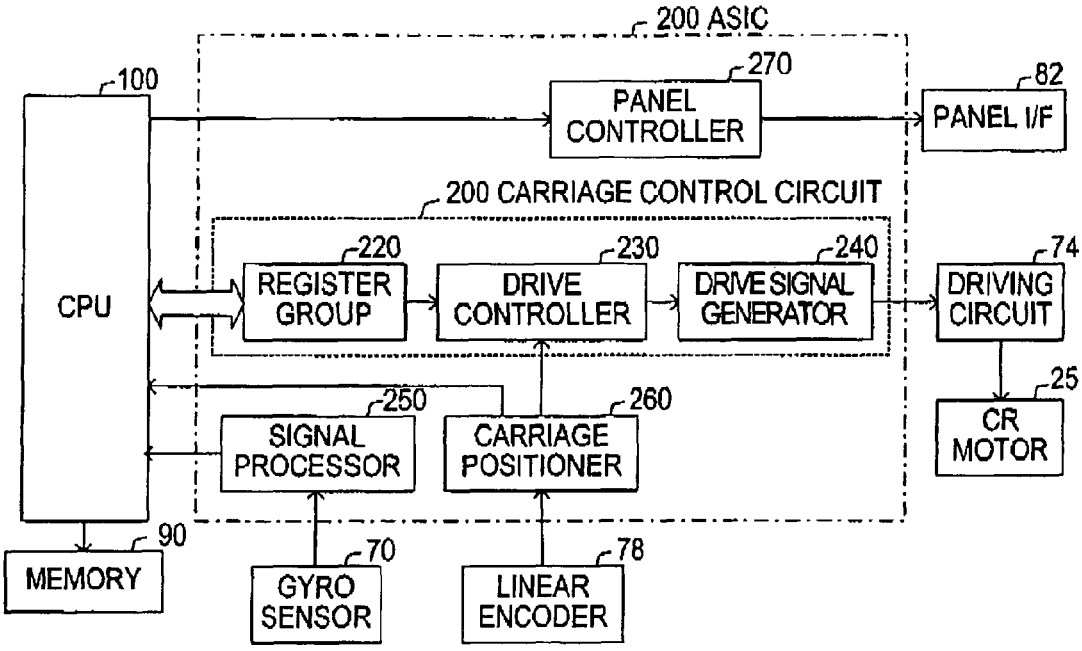
FIG. 5 is a block diagram showing a structure of an ASIC of the multi function apparatus according to the embodiment.

FIG. 5 is a block diagram showing the structure of the ASIC 200. FIG. 5 only shows a drive system of the carriage 5 which drives the carriage 6 and determines abnormality in the drive of the carriage 5. The other components of the ASIC 200 are omitted.

The ASIC 200 includes a carriage control circuit 210, a carriage positioner 260, a panel controller 270, and a signal processor 250. The carriage control circuit 210 drives and controls the CR motor 25 in response to directives from the CPU 100. The carriage positioner 260 detects the position of the carriage 5 based on the signal from the linear encoder 78. The panel controller 270 is used to select and outputs to the panel I/F 82 various messages to be displayed on the operation panel 14 in response to display directives from the CPU 100. The signal processor 250 processes (e.g., removes noise, performs A/D conversion, etc.) and outputs the signal inputted from the gyro sensor 70 to the CPU 100.

The carriage control circuit 210 generates a drive signal for controlling the rotation speed and the rotation direction of the CR motor 25 in response to the directives from the CPU 100, outputs the signal to the driving circuit 74 to drive the CR motor 25 via the driving circuit 74, and further reciprocates the carriage 5 in the main scanning direction via the timing belt 24.

The carriage control circuit 210 includes a register group 220, a drive controller 230, and a drive signal generator 240. Various parameters necessary for controlling the CR motor 25 are stored in the register group 220 by the CPU 100. The drive controller 230 calculates a manipulated variable of the CR motor 25 based on the parameters set in the register group 220. The drive signal generator 240 generates a PWM signal for duty driving of the CR motor 25 according to the manipulated variable calculated by the drive controller 230 and outputs the PWM signal to the driving circuit 74.

The register group 220 includes a start setting register that is used to start the CR motor 25, a maximum PWM duty setting register that is used to set the upper limit of a duty ratio of the PWM signal (maximum PWM duty) for driving the CR motor 25, a target speed setting register that is used to set a target driving speed of the CR motor 25, a controller parameter setting register and a feedback parameter setting register that are respectively used to set control gains and control constants necessary for a feedback control of the CR motor 25, a target stop position setting register that is used to set a target stop position of the carriage 5, a calculation timing setting register that is used to set calculation timing for calculating the manipulated variable of the CR motor 25 (i.e., PWM duty ratio as a driving force). The drive controller 230 generates a directive signal for driving the CR motor 25 based on the parameters set in the respective registers in the register group 220. The driving signal generator 240 generates a PWM signal according to the directive signal from the drive controller 230.

The carriage positioner 260 detects the rotation direction of the CR motor 26 from the detection signal outputted from the linear encoder 78. Also, the carriage positioner 260 is provided with a counter. When the detected rotation direction of the CR motor 25 (i.e., traveling direction of the carriage 5) is a forward direction, the counter is incremented in accordance with the detection signal. When the rotation direction of the CR motor 25 is a backward direction, the counter is decremented in accordance with the detection signal. In this manner, the carriage positioner 260 detects at which slit from the home position (position of the carriage 5 shown in FIG. 3) the carriage 5 is located, and outputs the detected position of the carriage 5 (count value) to the CPU 100 and the drive controller 230.

Figure 6:
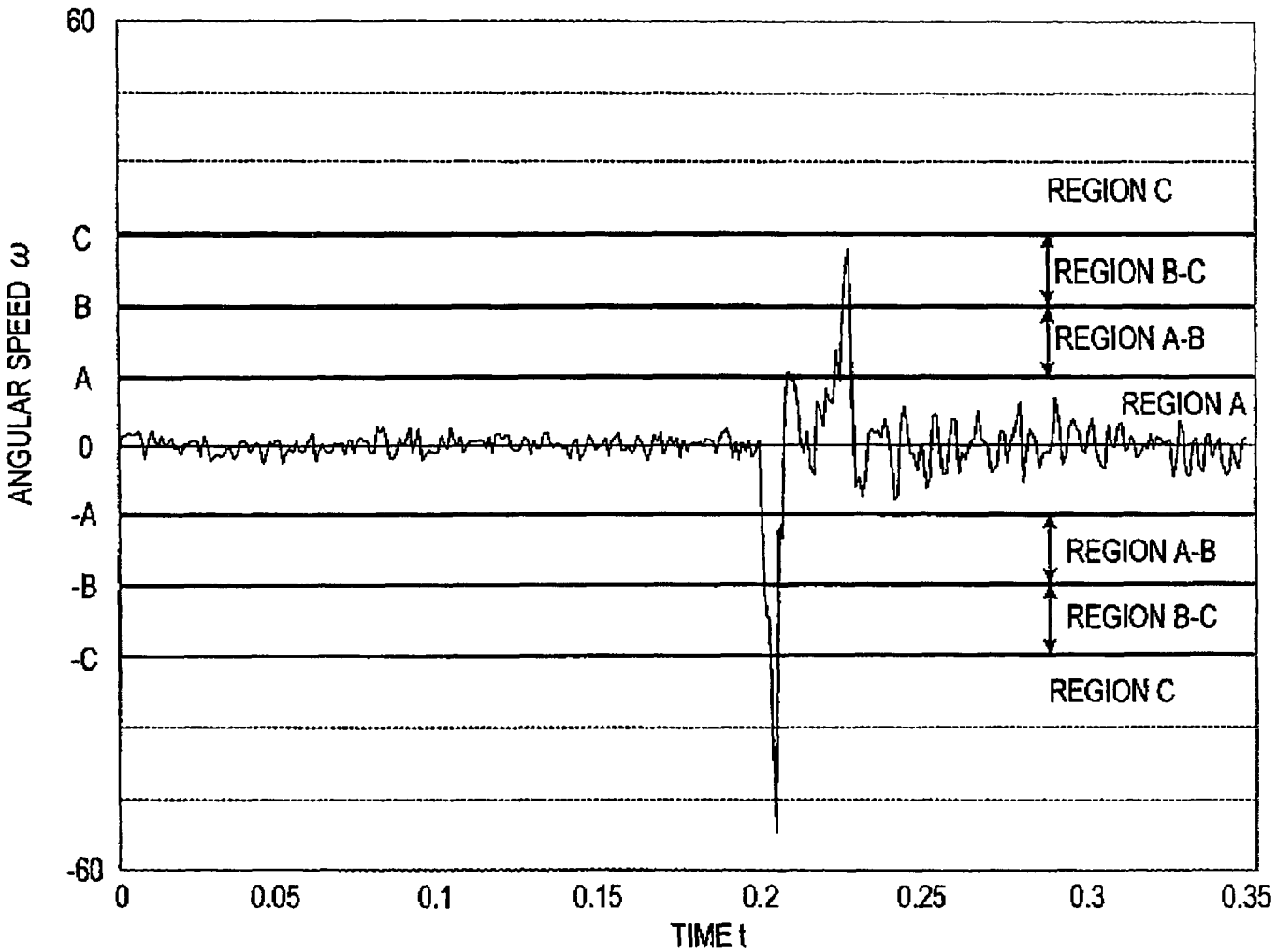
FIG. 6 is a referential diagram showing an angular speed $\omega$ detected by a gyro sensor.

The memory 90 stores three abnormal determination values A to C (see FIG. 6) as thresholds for the CPU 100 assessing the angular speed ω in order to determine abnormality in the conveyance system of the carriage 5. FIG. 6 is a referential diagram showing a change in the angular speed ω detected by the gyro sensor 70. Here, a horizontal axis corresponds to time t, and a vertical axis corresponds to the angular speed ω. A to C on the vertical axis corresponds to the abnormality determination values A to C. The abnormality determination value B is set to be larger than the abnormality determination value A in absolute value. The abnormality determination value C is set to be larger than the determination value B in absolute value.

FIG. 7 is a flowchart showing the carriage abnormality process performed by the CPU 100.

The carriage abnormality process is a process repeatedly performed by the CPU 100 from when the CPU 100 sets start directives to start a drive control of the carriage motor 25 to the start setting register of the register group 220 until the CR motor 25 is driven and image forming for one job is completed by operation of the ASIC 200.

When this process is started, it is firstly determined in S510 whether the angular speed ω inputted from the signal processor 250 is equal to or more than the abnormality determination value A (e.g., A=10°/s). While it is determined that the angular speed ω is less than the abnormality determination value A (S510: NO), the step of S510 is repeated.

On the other hand, if the angular speed ω is equal to or more than the abnormality determination value A (S510: YES), it is determined that there is abnormality in the conveyance system of the carriage 6. The process moves to S520 to determine whether the angular speed ω is equal to or more than the abnormality determination value B (e.g., B=20°/s). If it is determined that the angular speed ω is equal to or more than the abnormality determination value B (S520: YES), the process moves to S530 to determine whether the angular speed ω is equal to or more than the abnormality determination value C (e.g., B=30°/s). If it is determined that the angular speed ω is equal to or more than the abnormality determination value C (S530: YES), the process moves to S540 to stop the carriage 5 by the operation of the ASIC 200.

Subsequently in S550, it is determined whether position information indicating the position of the carriage 5 when the angular speed ω is equal to or more than the abnormality determination value C is stored in the memory 90. If the position information is not stored (S550: NO), the count value inputted from the carriage positioner 260 is read. The read count value is stored in the memory 90 as the position information when the angular speed ω is equal to or more than the abnormality determination value C in S560. The process moves to S570. In S570, display directives are inputted to the panel controller 270 of the ASIC 200 so that the liquid display 14*b* of the operation panel 14 displays a message, for example, to request the user to remove jammed paper, via the panel I/F 82. The process moves to S600.

It is then determined in S600 whether there is a depression of a predetermined button among the operation buttons 14*a* of the operation panel 14. If there is not a depression of the operation button (S600: NO), the step of S600 is repeatedly performed until the operation button is depressed. If there is a depression of the operation button (S600: YES), the process moves to S610 to perform initialization, i.e., the carriage 5 is returned to the home position, etc. After the initialization, the process is ended.

On the other hand, if it is determined in S550 that the position information when the angular speed ω is equal to or more than the abnormality determination value C is stored in the memory 90 (S550: YES), the process moves to S580. The count value inputted from the carriage positioner 260 is read to be newly stored in the memory 90 as a position information when the angular speed ω is equal to or more than the abnormality determination value C. Subsequently in S590, display directives are inputted to the panel controller 270 of the ASIC 200 to display a message e.g., to request the user to contact a service center, on the liquid display 14*b* of the operation panel 14 via the panel I/F 82. The process moves to S600.

When it is determined in S520 that the angular speed ω is less than the abnormality determination value B (S520: NO), the process moves to S620. It is determined whether the position information indicating the position of the carriage 5 when the angular speed ω is equal to or more than the abnormality determination value A is stored in the memory 90. If the position information is not stored (S620: NO), the process moves to S630. The count value inputted from the carriage positioner 260 when the angular speed ω is determined less than the abnormality determination value B is read to be stored in the memory 90 as the position information indicating the position of the carriage 5 when the angular speed ω is equal to or more than the abnormality determination value A.

Next in S640, it is determined whether the carriage 5 has stopped at the target stop position set in the register group 220 based on the count value inputted from the carriage positioner 260. In this manner, it is determined whether the carriage 5 has completed one scan line. While it is determined that the carriage 5 has not completed one scan line (S640: NO), the step of S640 is repeated. On the other hand, if it is determined that the carriage 5 has completed one scan line (S640: YES), the process moves to S650 to reduce the control gain set in the controller parameter setting register of the register group 220. The process moves to 5610 and the steps from S510 onwards are repeated. In the step of S650, the control gain is reduced so that sensitivity of the carriage control circuit 210 inside the ASIC 200 is lowered. This is to prevent the fluctuation in the traveling speed of the carriage 5 based on the change in posture of the carriage 5 from affecting the drive control of the CR motor 25. As a result, scanning of the carriage 5, that is, image forming is continued.

On the other hand, if it is determined in S620 that the position information when the angular speed ω is equal to or more than the abnormality determination value A is stored in the memory 90 (S620: YES), it is determined that the control gain is already reduced. The process moves to S530.

If it is determined in S530 that the angular speed ω is less than the abnormality determination value C (S530: NO), the process moves to S660 to determine whether position information indicating the position of the carriage 6 when the angular speed ω is equal to or more than the abnormality determination value B is stored in the memory 90. If the position information is not stored (S660: NO), the process moves to S670. The count value inputted from the carriage positioner 260 when the angular speed ω is determined less than the abnormality determination value C is read to be stored in the memory 90 as the position information indicating the position of the carriage 5 when the angular speed ω is equal to or more than the abnormality determination value B.

Next in S680, it is determined whether the carriage 5 has stopped at the target stop position set in the register group 220 based on the count value inputted from the carriage positioner 260. In this manner, it is determined whether the carriage 5 has completed one scan line. While it is determined that the carriage 5 has not completed one scan line (S680: NO), the step of S680 is repeated. On the other hand, if it is determined that the carriage 5 has completed one scan line (S680: YES), the process moves to S690 to reduce the target driving speed of the carriage 5 set in the target speed setting register of the register group 220. The process moves to S510 and the steps from S510 onwards are repeated. In the step of S690, the target driving speed of the carriage 5 is reduced so as to reduce the angular speed ω detected by the gyro sensor 70. As a result, image forming is continued although time required for image forming is lengthened.

On the other hand, if it is determined in S660 that the position information when the angular speed ω is equal to or more than the abnormality determination value B is stored in the memory 90 (S660: YES), it is determined that the target driving speed is already reduced. The process moves to S540. In S540, the carriage 5 is stopped and the steps from S550 onwards are executed.

The controller parameter setting register and the target speed setting register of which set values are changed in the carriage abnormality process are initialized when the next job is entered and the CR motor 25 starts to be driven again. Accordingly, when the carriage abnormality process is newly started, the respective registers always have initial values (the traveling speed and the control gain under normal operation).

As noted above, the multi function apparatus 1 according to the present embodiment detects the angular speed ω of the carriage 5 around the C axis using the gyro sensor 70 inside the carriage 5. Then, the multi function apparatus 1 determines whether there is abnormality in the conveyance system that moves the carriage 5, depending on whether the angular speed ω detected when the carriage 5 is moved exceeds the predetermined abnormality determination values A to C.

According to the multi function apparatus 1 of the present invention, abnormality in the conveyance system of the carriage 5 such as presence of foreign bodies in the guide members 22 and 23 or deformation of the guide members 22 and 23 can be promptly determined from the change in the angular speed ω of the carriage around the C axis detected while the carriage 5 is moved on the guide members 22 and 23, that is, the change in posture of the carriage 5.

Also in the multi function apparatus 1 according to the present embodiment, abnormality in the conveyance system of the carriage 5 is determined on whether the angular speed ω detected by the gyro sensor 70 exceeds the respective three abnormality determination values, that is, the abnormality determination value A, the abnormality determination value B which is larger than the abnormality determination value A, or the abnormality determination value C which is larger than the abnormality determination value B, as shown in FIG. 6. When the angular speed ω is equal to or more than the abnormality determination value A and is less than the abnormality determination value B (in the region A-B in FIG. 6), the control gain at the time when the CR motor 25 controls the travel of the carriage 6 is reduced. When the angular speed ω is equal to or more than the abnormality determination value B and is less than the abnormality determination value C (in the region B-C in FIG. 6), the target driving speed of the CR motor 25 is decreased. When the angular speed ω is equal to or more than the abnormality determination value C (in the region C in FIG. 6), the CR motor 25 is stopped. In this manner, the control method of the CR motor 25 is switched such that a suppression variable for the driving force becomes large as the abnormality determination value is increased.

Therefore, when abnormality is determined based on the smaller abnormality determination values (abnormality determination values A and B in the present embodiment; that is, when the degree of abnormality in the conveyance system of the carriage 5 is small; in other than the region C in FIG. 6), the carriage 5 is not immediately stopped and image forming is continued. Thus, it is convenient for the user since image printing may be performed to the last.

When abnormality in the conveyance system of the carriage 5 is determined, that is, when the angular speed ω of the carriage 5 around the C axis is equal to or more than the abnormality determination values A to C, the count value inputted from the carriage positioner 260 at the time when the angular speed ω is detected is read to be stored in the memory 90 as the position information of the carriage 5. Accordingly, the position of the carriage 5 on the guide members 22 and 23 when abnormality is determined in the conveyance system of the carriage 5 can be accurately known based on the position information stored in the memory 90. Thus, investigation into the cause of the abnormality is facilitated. It is also convenient to repair the multi function apparatus 1.

Furthermore, the gyro sensor 70 is formed together with the recording head 4 into the carriage 5 in the same semiconductor manufacturing process as the recording head 4. Thus, the manufacturing costs of the carriage 5 as well as the multi function apparatus 1 are reduced. Miniaturization of the carriage 5 is also achieved.

An embodiment of the present invention is described in the above. However, it should be noted that the present invention can be practiced in various manners.

For instance, in the above embodiment, whether the angular speed ω is equal to or more than the abnormality determination values A to C is determined by the CPU 100. However, the ASIC 200 may be provided with a posture abnormality determination device including a logic circuit, and the posture abnormality determination device may perform the determination.

The CR motor 25 may also be provided with a rotary encoder 92 (see FIG. 8) which has the same structure with the rotary encoder 56 attached to the conveying roller 50. A position abnormality determination device may be further provided which determines whether the carriage 5 is located at a predetermined position based on signals detected by the rotary encoder 92 and the linear encoder 78. Abnormality in the conveyance system of the carriage 5 may be determined on information on the position of the carriage 5.

From now on, the case is explained in which the aforementioned posture abnormality determination device and the position abnormality determination device are in the multi function apparatus 1, as a variation of the above embodiment.

Figure 8:
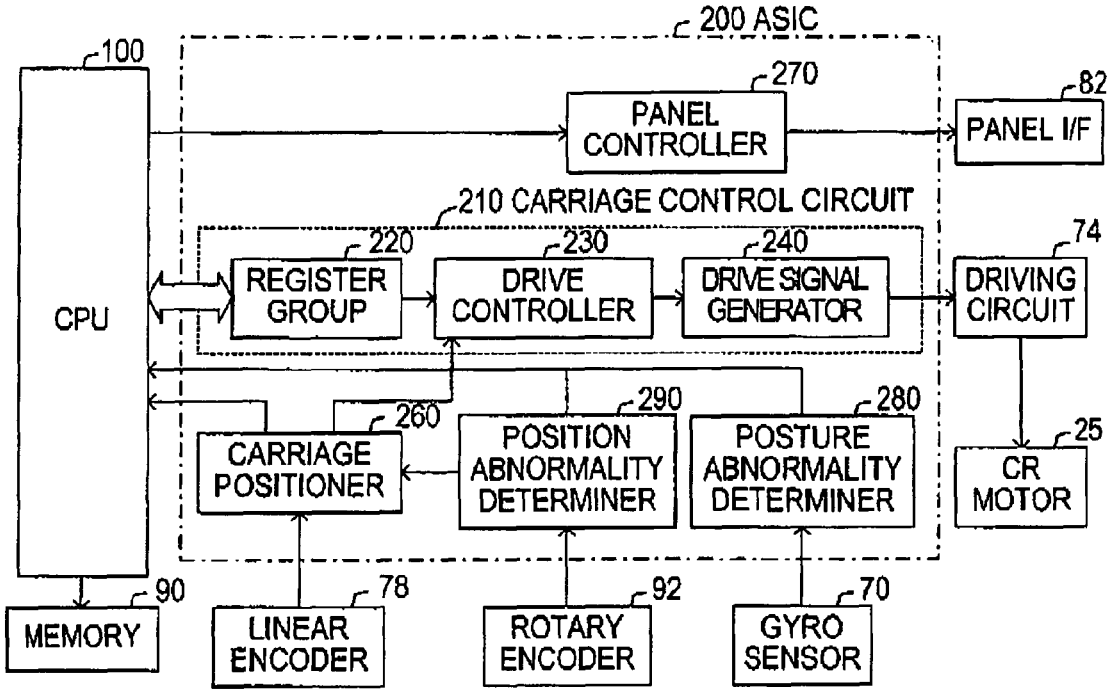
FIG. 8 is a block diagram showing a structure of an ASIC of a multi function apparatus according to a variation.

FIG. 8 is a block diagram showing the structure of the ASIC 200 in the multi function apparatus 1 according to the variation. The ASIC 200 in the present variation is different from the ASIC 200 in the above embodiment in that a posture abnormality determiner 280 and a position abnormality determiner 290 are added instead of the signal processor 250. Therefore, only the description on the added components will be given hereinafter. The posture abnormality determiner 280 and the position abnormality determiner 290 repetitively operate at predetermined timings from when the CPU 100 sets the start directives to start the drive control of the CR motor 25 to the start setting register in the register group 220 until the CR motor 25 is driven by the operation of the ASIC 200 to complete image forming for one job.

The posture abnormality determiner 280 takes in the angular speed ω outputted from the gyro sensor 70 at a predetermined timing and determines whether the angular speed ω taken in is equal to or more than the abnormality determination value A (e.g., A=10°/s). If the angular speed ω is determined less than the abnormality determination value A, the posture abnormality determiner 280 ends its operation. On the other hand, if the angular speed ω is equal to or more than the abnormality determination value A, the posture abnormality determiner 280 determines that there is abnormality in the conveyance system of the carriage 5. The posture abnormality determiner 280 further determines whether the angular speed ω is equal to or more than the abnormality determination value B (e.g., B=20°/s).

If the angular speed ω is less than the abnormality determination value B, the posture abnormality determiner 280 outputs a posture abnormality signal A to the CPU 100 and ends its operation. If the angular speed ω is equal to or more than the abnormality determination value B, the posture abnormality determiner 280 further determines whether the angular speed ω is equal to or more than the abnormality determination value C (e.g., C=30°/s).

If the angular speed ω is less than the abnormality determination value C, the posture abnormality determiner 280 outputs a posture abnormality signal B to the CPU 100 and ends its operation. If the angular speed ω is equal to or more than the abnormality determination value C, the posture abnormality determiner 280 outputs a posture abnormality signal C to the CPU 100 and ends its operation.

The position abnormality determiner 290 determines whether a distance to move the carriage 5 (hereinafter, referred to as "directed distance") is consistent with the distance the carriage 5 has actually traveled (hereinafter, referred to as "actual distance") at a predetermined timing. If not, the position abnormality determiner 290 determines that there is abnormality in the conveyance system of the carriage 5. Then, the position abnormality determiner 290 outputs a position abnormality signal to the CPU 100 and ends its operation. Here, the directed distance is detected by counting a pulse signal outputted from the rotary encoder 92 attached to the CR motor 25, while the actual distance is detected by reading the count value inputted from the carriage positioner 260 based on the pulse signal outputted from the linear encoder 78 attached to the carriage 5.

FIG. 9 is a flowchart showing a carriage abnormality process performed by the CPU 100 of the multi function apparatus 1 according to the variation. The flowchart of FIG. 9 is different from the flowchart of FIG. 7 in that S510 to S530 are replaced with the steps S710 to S720. Therefore, only the explanation on the steps from S710 to S720 will be given.

In the carriage abnormality process according to the variation is started by an input of one of the position abnormality signals A to C from the posture abnormality determiner 280 or the position abnormality signal from the position abnormality determiner 290. When the process is started, it is firstly determined in S710 whether the input signal is the posture abnormality signal A.

If the input signal is the posture abnormality signal A (S710: YES), the process moves to S620. The steps from S620 and onwards are executed. On the other hand, if the input signal is not the posture abnormality signal A (S710: NO), the process moves to S720. It is determined in S720 whether the input signal is the posture abnormality signal B. If the input signal is the posture abnormality signal B (S720: YES), the process moves to S660. The steps from S660 and onwards are executed. If the input signal is not the posture abnormality signal B (S720: NO), it is determined that the input signal is the posture abnormality signal C or the position abnormality signal. The process moves to S540. The carriage 5 is stopped and the steps from S550 and onwards are executed.

As noted above, the multi function apparatus 1 according to the present variation is designed such that the determination on whether the angular speed ω detected when the carriage 5 is moved exceeds the respective abnormality determination values A to C, that is, whether there is abnormality in the conveyance system of the carriage 5, is performed by the posture abnormality determiner 280 instead of the CPU 100 as in the above embodiment.

Therefore, in the multi function apparatus 1 according to the present variation as well, the same effects as in the above embodiment can be achieved.

Moreover, in the multi function apparatus 1 according to the present variation, the position abnormality determiner 290 detects the directed position of the carriage 5 by counting the pulse signal outputted from the rotary encoder 92 when the carriage 5 is moved. The position abnormality determiner 290 also detects the actual position of the carriage 5 from the count value inputted from the carriage positioner 260. Abnormality in the conveyance system of the carriage 5 is determined on whether the detected directed position is consistent with the actual position. If abnormality is determined, the position abnormality signal is outputted to the CPU 100. Thus, abnormality in the conveyance system of the carriage 5 is reliably detected.

In the multi function apparatus 1 of the above embodiment and variation, the angular speed ω around the C axis of the carriage 5 is detected by the gyro sensor 70. However, angular speeds around three axes of the carriage 5 may be detected by using three gyro sensors which can respectively detect an angular speed around one axis or using one gyro sensor that can detect respective angular speeds around three axes.

In this manner, the change in posture of the carriage 5 around three axes can be detected. Thus, abnormality in the conveyance system of the carriage 5 can be more reliably determined.

The multi function apparatus 1 of the above embodiment and variation is designed such that the CPU 100 executes at least part of the process of determination and post-determination of abnormality in the conveyance system of the carriage 5. However, all the process may be executed by the operation of a logic circuit provided inside the ASIC 200.

Also in the multi function apparatus 1 according to the variation, abnormality in the conveying system of the carriage 5 is determined based on the directed distance and the actual distance of the carriage 5. However, abnormality may be determined based on a change in speed of the carriage 5 which is calculated based on the position information of the carriage 5.

What is claimed is:

1. An image forming apparatus comprising:

an image forming device that forms an image onto a recording medium by moving a carriage mounting a recording head thereon;

an angular speed detection device that detects an angular speed around a predetermined axis of the carriage caused by a posture change of the carriage, the carriage including the angular speed detection device; and an abnormality determination device that determines abnormality in a conveyance system that moves the carriage based on whether the angular speedy detected by the angular speed detection device when the carriage is moved, exceeds a predetermined abnormality determination value.

2. The image forming apparatus according to claim 1, further comprising:

an abnormality control device that suppresses a driving force of a driving device that moves the carriage when abnormality in the conveyance system of the carriage is detected by the abnormality determination device, so that image forming is continued.

3. The image forming apparatus according to claim 2:

wherein the abnormality determination device determines whether the angular speed detected by the angular speed detection device exceeds respective abnormality values including at least a first abnormality determination value and a second abnormality determination value of which absolute value is larger than the first abnormality determination value; and wherein the abnormality control device switches its control such that a suppression variable for the driving force when it is determined that the angular speed exceeds the second abnormality determination value by the abnormality determination device is larger than the suppression variable when it is determined that the angular speed exceeds the first abnormality determination value.

4. The image forming apparatus according to claim 1, further comprising:

a position detection device that detects a position of the carriage; and a position information storage device that takes in information on the position of the carriage detected by the position detection device and stores the position information in a memory device, when it is determined that operation of the carriage is abnormal by the abnormality determination device.

5. The image forming apparatus according to claim 4, further comprising:

a position abnormality determination device that determines abnormality in the conveyance system of the carriage based on the position information of the carriage detected by the position detection device when the carriage is moved.

6. The image forming apparatus according to claim 1;

wherein the angular speed detection device is a gyro sensor that is integrally formed with the recording head and detects the angular speed around the predetermined axis of the carriage.

* * * * *